United States Patent [19]

Critchley et al.

[11] Patent Number: 4,984,510

[45] Date of Patent: Jan. 15, 1991

[54] SYSTEM FOR POSTING ARTICLES INTO A CONTAINMENT

[75] Inventors: Richard J. Critchley, Chorley; Samuel R. Oldham, Tameside, both of United Kingdom

[73] Assignee: British Nuclear Fuels Plc, Warrington, England

[21] Appl. No.: 180,081

[22] Filed: Apr. 11, 1988

[30] Foreign Application Priority Data

May 1, 1987 [GB] United Kingdom ..... 8710388

[51] Int. Cl.[5] ..... G21K 5/00

[52] U.S. Cl. ..... 98/1; 252/633; 414/292

[58] Field of Search ..... 98/1, 115.1, 115.3; 252/628, 633; 414/146, 217, 292

[56] References Cited

U.S. PATENT DOCUMENTS

| | | | |
|---|---|---|---|
| 3,986,630 | 10/1976 | Catlin et al. | 29/422 X |
| 4,582,638 | 4/1986 | Humel et al. | 252/633 |
| 4,755,347 | 7/1988 | Tolmie | 414/146 X |

*Primary Examiner*—Harold Joyce

*Attorney, Agent, or Firm*—William R. Hinds

[57] ABSTRACT

A sphincter seal, to accommodate variations in diameters of drums, is employed at a posting port into a containment. The seal comprises an annular assembly of inner and outer brush seals between which are sandwiched rings of resilient material. An elastic garter is secured to the resilient rings to resist deformation of the rings through use.

4 Claims, 9 Drawing Sheets

SYSTEM FOR POSTING ARTICLES INTO A CONTAINMENT

The present invention concerns a system for posting articles into a containment which is maintained at sub-atmospheric pressure. In particular the invention concerns a posting system with a port having a sphincter seal for minimising back diffusion through the port during a posting operation.

FEATURES AND ASPECTS OF THE INVENTION

According to the present invention a system for posting articles into a containment maintained at sub-atmospheric pressure comprises a posting port in the wall of the containment having a sphincter seal and a removable cover or lid, the sphincter seal being such as to engage articles posted through the port and to permit an inward air flow into the containment to oppose back-diffusion from the containment.

Preferably, the sphincter seal comprises an annular assembly of inner and outer brush seals between which are sandwiched rings of resilient material. The outer annular brushes of the assembly serve to protect the resilient rings during posting operations. The lower annular brushes serve to support the resilient rings and help prevent permanent deformation. Both inner and outer brushes restrict the opening in the containment during posting operations.

DESCRIPTION OF THE DRAWINGS

The invention will be described further, by way of example, with reference to the accompanying drawings; in which.

DESCRIPTION OF THE PREFERRED EMBODIMENT

Figure 1:
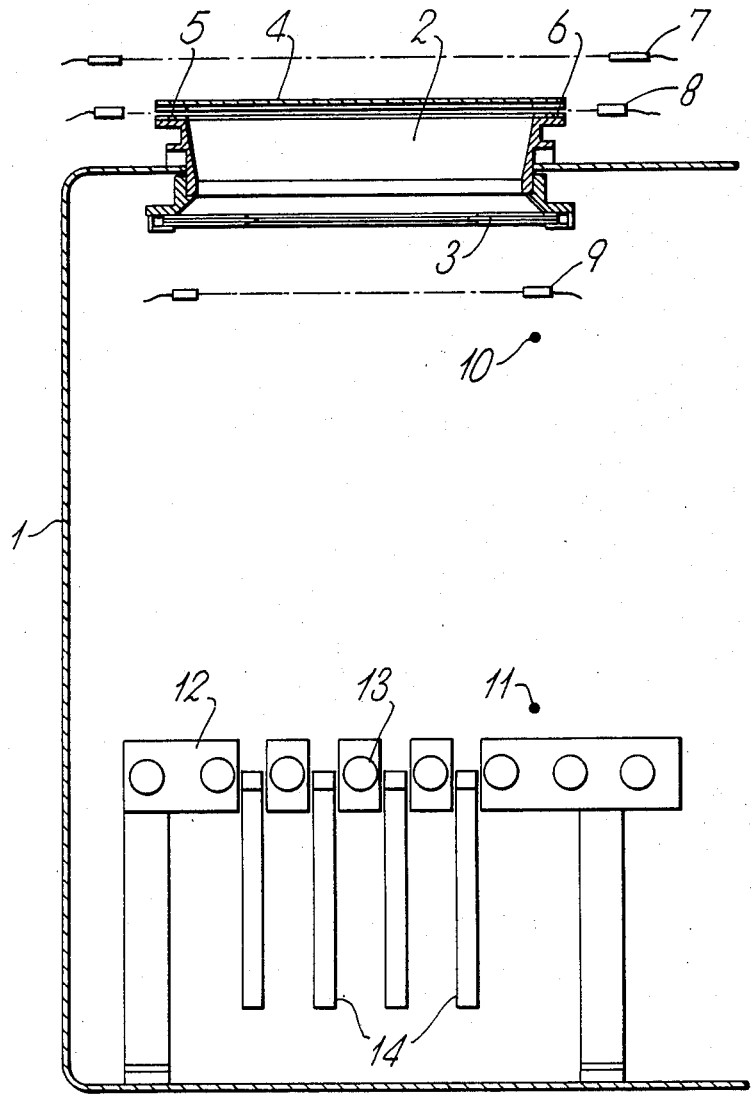
FIGS. 1 to 8 depict diagrammatically successive steps in the posting of waste drums into a containment.

In FIGS. 1 to 8, a containment 1 is provided with a posting port 2 through which drums of radioactive waste materials can enter into the containment. The port 2 comprises an annular sphincter seal 3 and a removable lid or cover 4. The lid or cover 4 sealingly engages an inflatable seal 5 mounted in a lip 6 at the outer end of the port 2. Various detectors for controlling the sequence of operation are denoted by the reference numerals 7 to 11 respectively and the function of which will be described in the following description. A platform comprising a roller conveyor assembly 12 is located within the containment 1 below the port 2. A hoist 14 in the form of a fork cooperates with the conveyor assembly 12 such that the fork can pass between rollers 13 of the conveyor assembly. In FIG. 1 the hoist is shown in a retracted position.

Figure 2:
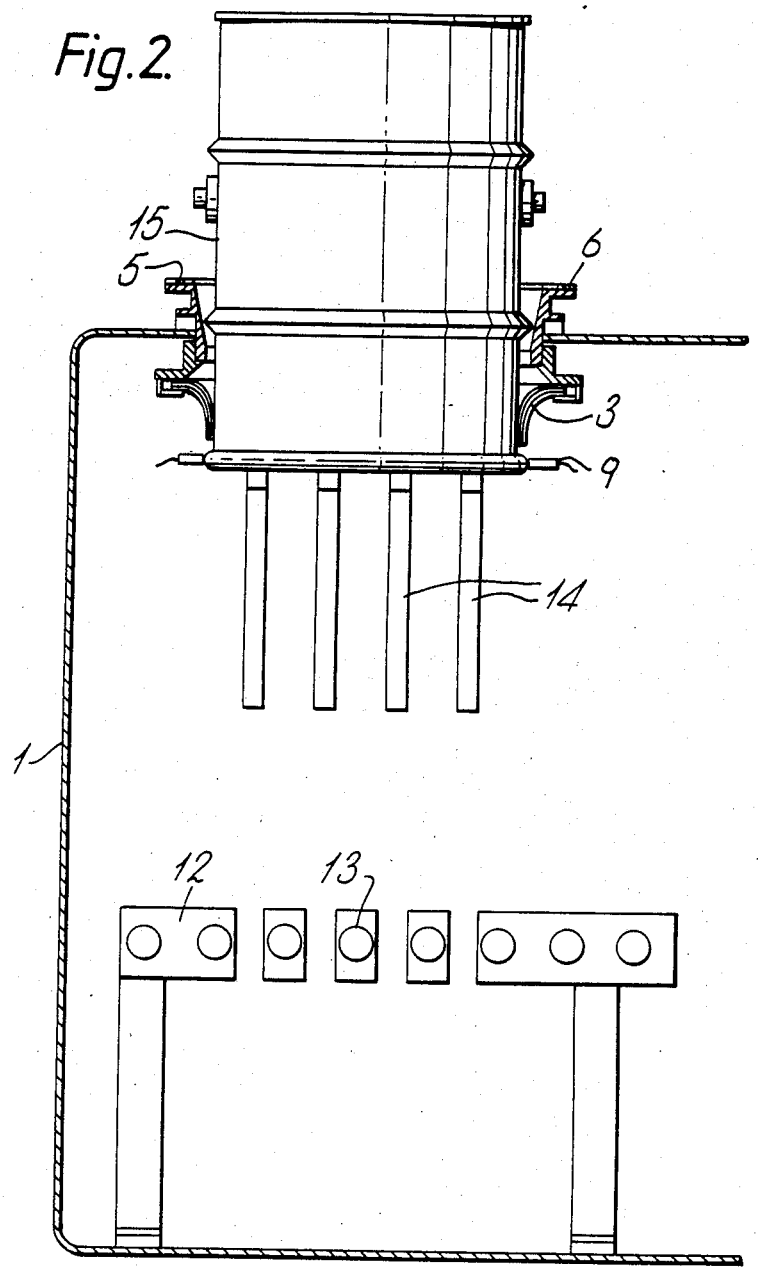

To enter a first drum into the containment, the hoist 14 is raised to its highest position, which will be indicated by position switch 10, the lid or cover 4 is removed to expose the port 2, and a drum 15 supported by a crane or hoist (not shown) is lowered through the port on to the raised hoist 14. This position is depicted in FIG. 2. The sphincter seal 3 engages the lower end of the drum 15. The detectors 7,8 and 9 can be infra-red switch devices and in FIG. 2 the drum interrupts signals from transmitters to receivers at the detection positions.

Figure 3:
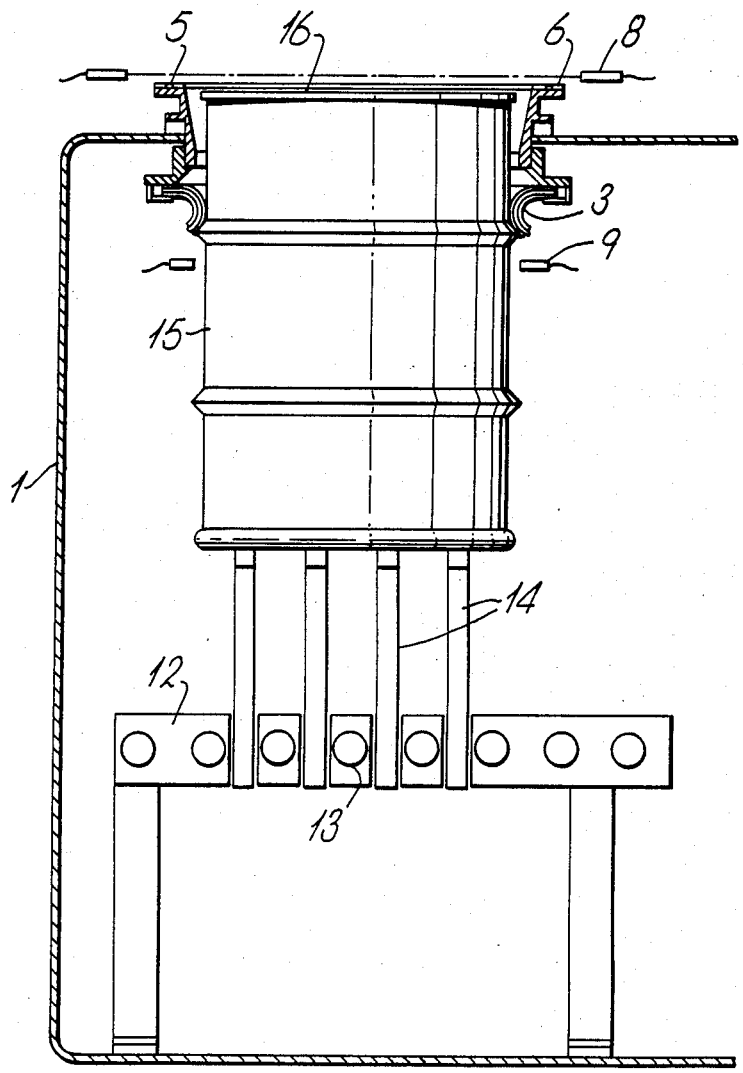

With the drum 15 on the hoist 14, the hoist is then lowered to lower the drum 15 into the containment until the drum lid 16 is level with or just below the lip 6 as shown in FIG. 3. This is indicated by the detector 8 which initiates a signal to interrupt the hoist drive mechanism. The sphincter seal 3 remains at all times in engagement with the drum 15. During normal operation, a drum is always present in the port. This condition is only changed either at commencement of operation or if it becomes necessary to change and renew the sphincter seal.

Figure 4:
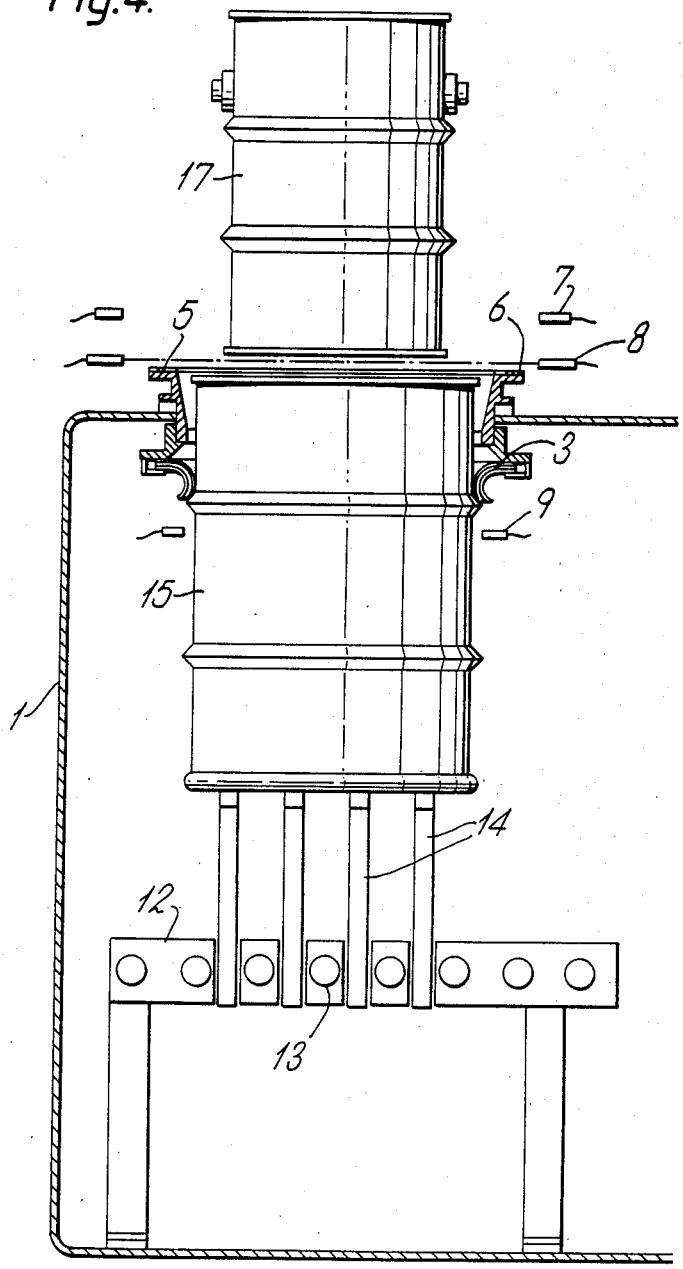
Figure 5:
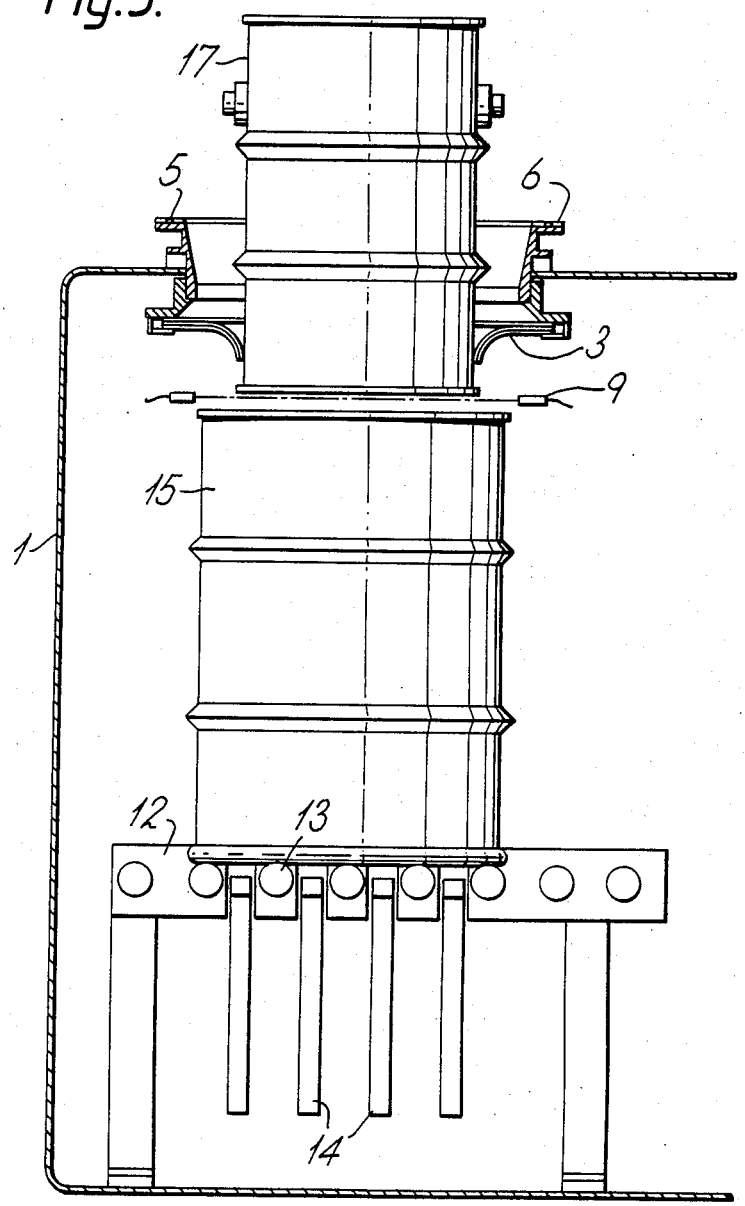

During normal operation a second drum 17, FIG. 4, is then lowered by the external crane or hoist to above the drum 15. The drum 17 on breaking the signal at the detector 7 initiates a signal to recommence the hoist drive mechanism. The hoist 14 retracts to lower the drum 15 on to the roller conveyor assembly 12 and the fully withdrawn position of the hoist is indicated by a signal from detector 11 which stops the hoist drive mechanism. The drum 17, still supported by the external crane or hoist is at the same time lowered into the containment 1 and stops when the top of the drum 15 clears the detector 9. This position is shown in FIG. 5. The sphincter seal 3 is now in engagement with the surface of the drum 17.

Figure 6:
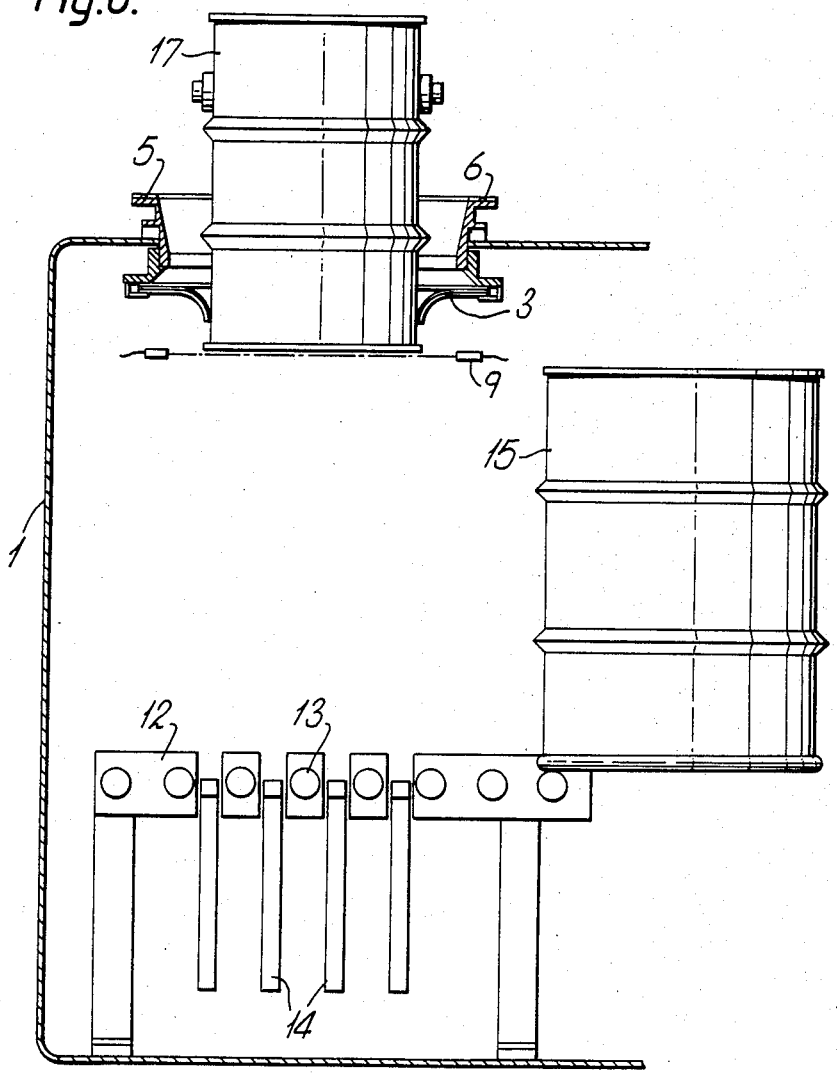
Figure 7:
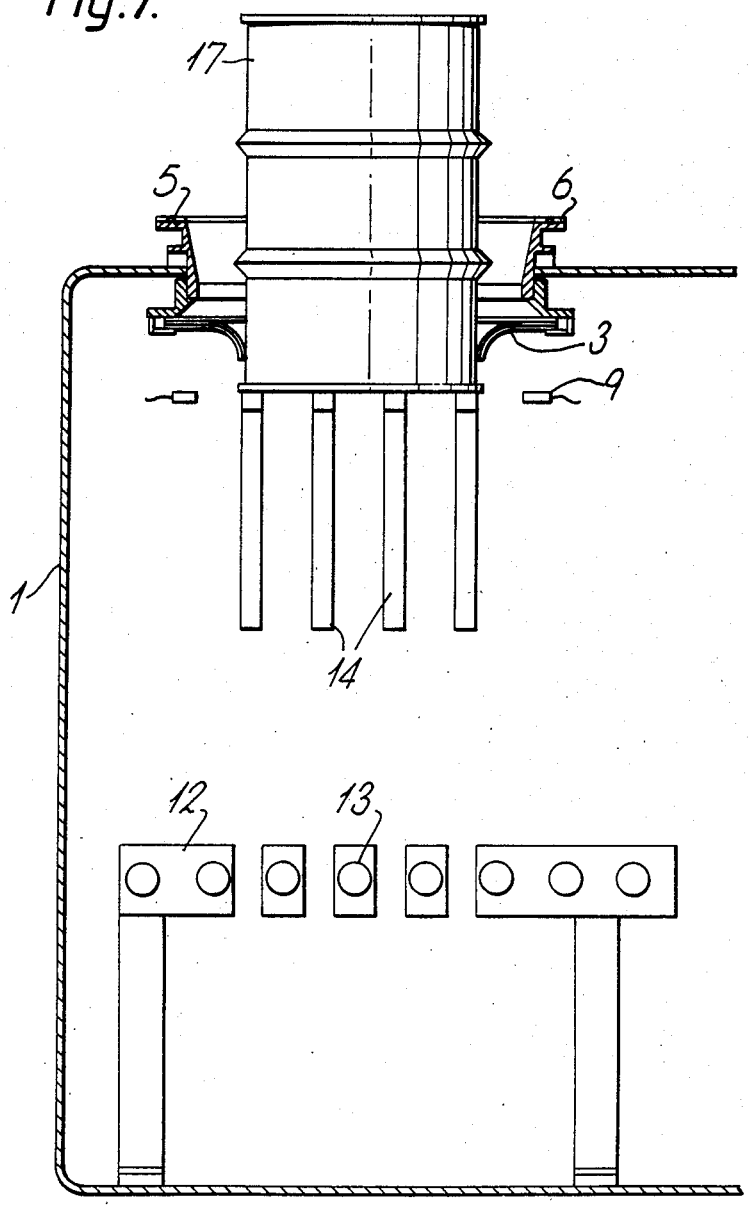
Figure 8:
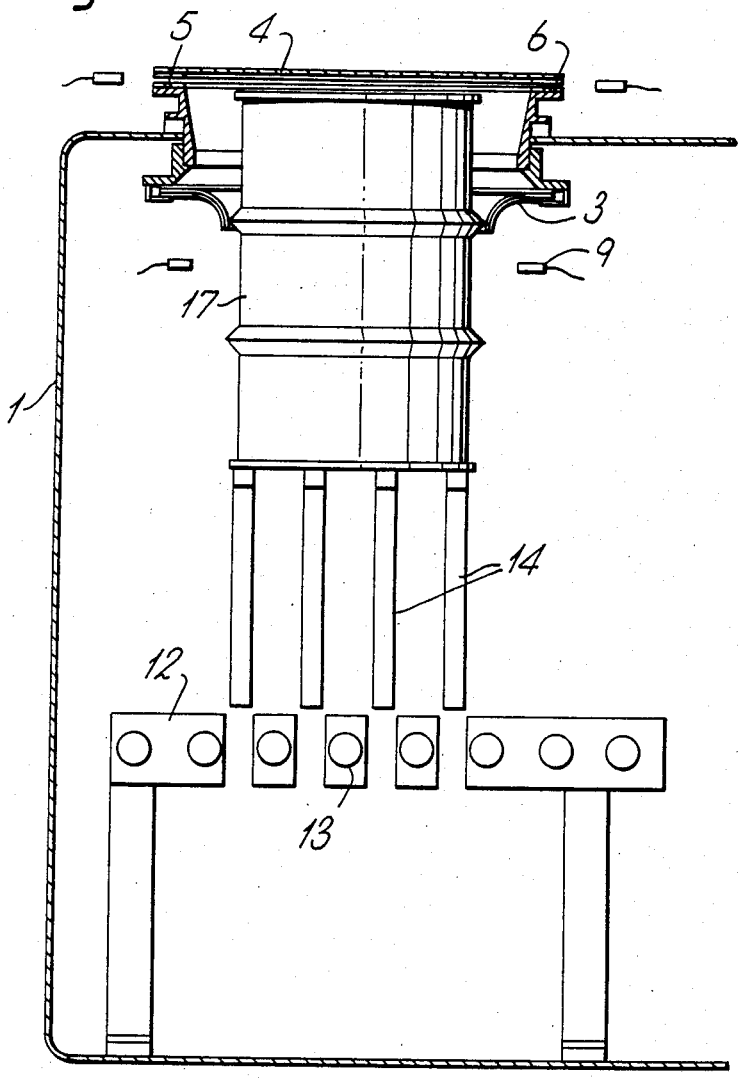

In FIG. 6, the drum 17 is supported in the port by the external crane or hoist and the first drum 15 is moved off the roller conveyor assembly 12 and through an airlock door (not shown) into a work area within the containment. Thereafter, the airlock door is closed and the hoist 14 is raised again to its highest position as indicated by the detector 10. The drum 17 is lowered on to the hoist 14 and released from the external crane or hoist. This position is shown in FIG. 7. The drum 17 is then lowered on the hoist until the detector 8 is again actuated. The lid 4 can then be closed to form a secondary seal arrangement (FIG. 8). The drum 17 remains in this position, with the lid closed, until a further drum is ready for transfer through the port into the containment. The lid 4 is then reopened to allow the posting operation to take place.

The sequence of operation is then repeated with the drum 17 and the further drum to be entered into the containment.

The sphincter seal serves to reduce the opening between the interior of the containment and the atmosphere during posting operations such that the containment ventilation system can maintain an inward linear air flow, typically 1 m/sec, thus preventing back diffusion of airborne contamination from the containment.

Figure 9:
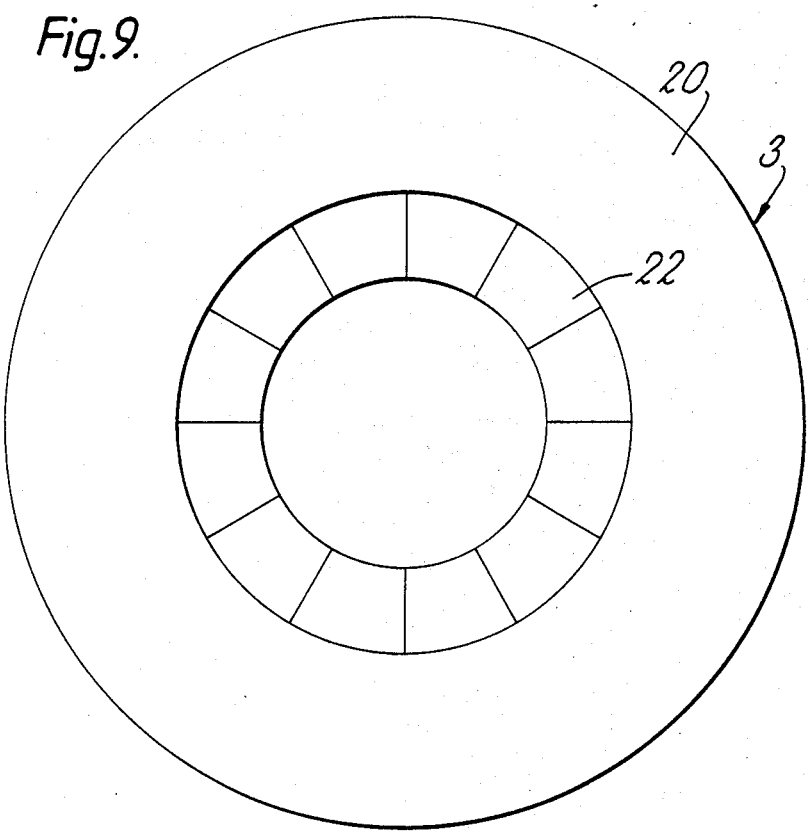
FIGS. 9 and 10 are respectively a plan and section of a sphincter seal used at a posting port into the containment.
Figure 10:
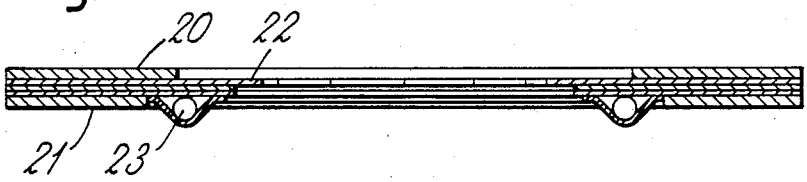

A preferred form of sphincter seal is shown in FIGS. 9 and 10. The seal 3 is an annular assembly comprising outer or upper and inner or lower brush seals 20 and 21, conveniently nylon brushes, between which are sandwiched rings of natural or synthetic rubber 22, each ring being divided into sectors. The rubber rings extend radially inwardly beyond the inner radius of the nylon brushes. A continuous elastic garter 23 is secured to the underside of the lowermost ring 22 projecting inwardly beyond the lower brush. As a drum is passed through the port the sphincter seal is deformed as indicated in FIGS. 1 to 8 but at all times maintains a positive contact with the drum over the periphery of the drum. The seal can accommodate changes in diameter of individual drums and also different sizes of drums. The garter 23 serves to resist deformation of the seal during use and ensures that the seal returns to its natural state after passage of a drum through the port.

We claim:

1. A system for posting articles into a containment maintained at sub-atmospheric pressure comprising a posting port in a wall of the containment having a sphincter seal and a removable lid, the sphincter seal being such as to engage articles posted through the port and to permit an inward air flow into the containment to oppose back-diffusion from the containment.

2. A system according to claim 1 in which the sphincter seal comprises an annular assembly of inner and outer brush seals between which are sandwiched rings of resilient material.

3. A system according to claim 2 in which each ring of resilient material is divided into sectors which extend radially inwardly beyound the inner radius of the brush seals.

4. A system according to claim 3 including a continuous elastic garter secured to the underside of the resilient material.

* * * * *